US005857946A

United States Patent [19]

Brown

[11] Patent Number: 5,857,946

[45] Date of Patent: Jan. 12, 1999

[54] VARIABLE RESISTANCE REFILLABLE EXERCISE DUMBBELL

[76] Inventor: Claudia D. Brown, 9157 Frances St., Omaha, Nebr. 68124

[21] Appl. No.: 810,735

[22] Filed: Apr. 24, 1996

Related U.S. Application Data

[63] Continuation-in-part of Ser. No. 398,451, Mar. 3, 1995, abandoned.

[51] Int. Cl.[6] ..... A63B 21/072

[52] U.S. Cl. ..... 482/108; 482/105

[58] Field of Search ..... 482/93, 106–109, 482/50

[56] References Cited

U.S. PATENT DOCUMENTS

| | | | |
|---|---|---|---|
| 3,734,493 | 5/1973 | Hasekian | 482/108 X |
| 4,712,794 | 12/1987 | Hall | 482/108 X |
| 4,854,575 | 8/1989 | Wilson et al. | 482/108 |
| 5,056,778 | 10/1991 | Hull et al. | 482/108 |

FOREIGN PATENT DOCUMENTS

| | | | |
|---|---|---|---|
| 2525473 | 12/1976 | Germany | 482/108 |

*Primary Examiner*—Richard J. Apley
*Assistant Examiner*—John Mulcahy
*Attorney, Agent, or Firm*—Dennis L. Thomte

[57] ABSTRACT

A variable resistance refillable exercise apparatus includes a generally hollow container having an outer surface and an interior volume, top and bottom generally bulbous end sections and a reduced circumference waist section between the end sections such that the container is generally dumbbell-shaped. A container fill opening is formed in the container extending between the outer surface and interior volume for filling the container with fluids and/or solids, and a cap is provided for removably sealing the container fill opening. A handle extends between and connects the top and bottom generally bulbous end sections, the handle including a gripping device such as finger-shaped depressions for facilitating gripping of the handle. A weight scale is printed on the container, the weight scale including a plurality of generally parallel lines and at least one weight amount marking adjacent the lines, the weight scale facilitating measurement of a specific amount of fluid and/or solids within the container to determine the amount of resistance to lifting the container. Finally, a strap is detachably and adjustably mounted on the container whereby the container may be removably attached to a user of the exercise apparatus.

7 Claims, 3 Drawing Sheets

VARIABLE RESISTANCE REFILLABLE EXERCISE DUMBBELL

CROSS REFERENCE TO RELATED APPLICATION

This is a continuation-in-part of patent application Ser. No. 08/398,451, filed Mar. 3, 1995, now abandoned.

BACKGROUND OF THE INVENTION

1. Technical Field

This invention relates to variable resistance exercise equipment and, more particularly, to a variable resistance refillable exercise apparatus including a hollow container which is generally dumbbell-shaped and has a permanent handle, the container being fillable with various materials such as sand and/or water to provide variable resistance to lifting of the container by a user of the exercise apparatus.

2. Description of the Prior Art

Resistance training exercise devices are important tools in building and toning muscles in the body. Various types of exercising devices have been proposed and are being used, including free weights, dumbbells, weight stack gym sets and devices such as the SOLOFLEX machine. However, with the notable exception of dumbbells, the user of the resistance exercise device must go to the location of the device to use it, and may not transport the device to a different location without encountering much difficulty. There is therefore a need for an easily portable resistance training device.

It is further desirable to have an exercise apparatus which may be adjusted to provide variable resistance to lifting of the apparatus. Several examples are found in the prior art which attempt to address this need, such as Hull et al., U.S. Pat. No. 5,056,778, Elmore et al., U.S. Pat. No. 4,913,422, and Piccini, U.S. Pat. No. 4,378,113. However, without exception, none of these prior art devices provides a simple and efficient system by which the exact weight of the exercise apparatus may be determined. There is therefore a need for an exercise apparatus which is capable of providing variable resistance which may be accurately measured.

It is likewise important that any exercise apparatus be usable by a variety of persons, including those having large hands, small hands or arthritic hands or the like which restrict the ability of the person to hold items in their hand. It is well known that the gripping of large-diameter cylinders, such as those found in Hull et al. and Elmore et al., are not easily gripped by persons having small or weak hands. It is just these persons, however, who most often need to do exercise to increase the strength in their various limbs, and therefore there is a need for an easily grippable exercise apparatus.

Finally, many of the prior art exercise devices cannot be used in connection with the working out of ankles or legs, as many of the prior art devices do not include straps or the like for securing the exercise device to the foot or leg of the user. Moreover, whereas Hull et al. does disclose a strap for securing the barbell to a shoe, it is clear that the shape of Hull does not lend itself to such a use, and furthermore requires multiple straps to secure the barbell to the shoe (see FIG. 3 of Hull). There is therefore a need for an exercise apparatus which may be quickly and easily attached at various points on the body to allow for exercising of the various limbs.

Therefore, an object of the present invention is to provide an improved variable resistance refillable exercise apparatus.

Another object of the present invention is to provide an exercise apparatus which may be filled with water, sand or the like to varying degrees to provide variable resistance when lifting the apparatus.

Another object of the present invention is to provide an exercise apparatus which may be easily used by any persons wishing to exercise, and is particularly suited for use by persons having small hands, persons having weak hands and/or travelers.

Another object of the present invention is to provide an exercise apparatus which may be quickly filled with fluid and/or sand to a determinable degree whereby an exact weight resistance may be determined.

Another object of the present invention is to provide an exercise apparatus which includes a strap for fastening the device to a body limb for exercising of that limb.

Finally, an object of the present invention is to provide a variable resistance refillable exercise apparatus which is simple and durable in construction and safe and efficient in use.

SUMMARY OF THE INVENTION

The present invention provides a variable resistance refillable exercise apparatus which includes a generally hollow container having an outer surface and an interior volume, top and bottom generally bulbous end sections and a reduced circumference waist section between the end sections such that the container is generally dumbbell-shaped. A container fill opening is formed in the container extending between the outer surface and the interior volume of the container for filling the container with sand, water, etc. A cap removably seals the container fill opening. A permanent handle extends between and connects the top and bottom generally bulbous end sections, the handle further including a gripping device such as finger-sized depressions or padded grip-tape for facilitating gripping of the handle. The container further includes a weight scale which has a plurality of generally parallel lines and at least one weight amount marking adjacent the lines for determining the weight of the container when water or another such material is filled to a certain level within the container. Finally, a strap is detachably and adjustably mounted on the container so that the container may be removably attached to a user of the exercise apparatus.

The exercise apparatus may further include a plurality of interior baffles which act to prevent substantial movement of the contents of the container. The base of the container may also include a plurality of radial ribs which form a generally flat base for the container so that the exercise apparatus may be stood on end while being filled or when not in use.

It is thus seen that the present invention provides a substantial improvement over those devices found in the prior art. For example, the inclusion of an easily readable weight scale on the side of the container of the present invention allows for accurate filling of the container to provide precise resistance measurements for weight training purposes. Additionally, the molded handle may be easily gripped by persons of all types of hand strengths and sizes, thus enabling the present invention to be used by the widest variety of exercisers. The strap allows the container to be attached to a person's body at various points thereon, and because of the gently rounded shape of the container, the container may be comfortably placed adjacent to many body surfaces, as opposed to the straight lines found in many of the prior art devices. Finally, because of the lightweight, semi-flexible plastic material of which the container is preferably constructed, the container is easily transportable and, in fact, may be collapsed to fit within luggage or the like such that travelers may use the exercise apparatus of the present invention in locations away from home. It is thus seen that the present invention provides a substantial improvement over those devices found in the prior art.

BRIEF DESCRIPTION OF THE DRAWINGS

FIG. 9 is a side elevational view of the container emptied of weight material and collapsed for placement into a gym bag, purse or the like.

DESCRIPTION OF THE PREFERRED EMBODIMENT

The variable resistance refillable exercise apparatus 10 of the present invention is shown in its preferred embodiment in FIGS. 1–4 as including a hollow container 12 which is generally dumbbell-shaped. Container 12 further includes top and bottom generally bulbous end sections 14 and 16 and a waist section 18 having a smaller circumference than the top and bottom bulbous sections 14 and 16. It is preferred that container 12 be approximately the same size as a one-gallon milk container and therefore would hold approximately one gallon of fluid or solid, although it is to be understood that numerous different sizes of the exercise apparatus 10 of the present invention may be employed depending upon the needs of the user.

It is preferred that container 12 be constructed of light weight, semi-rigid waterproof plastic such as that used in the construction of plastic milk cartons. However, it may be preferable to use a less rigid plastic in constructing the container 12 to enable the container 12 to be collapsed upon removal of the contents of the container 12, thus allowing for easy transportation of the container 12 to another location.

Figure 2:
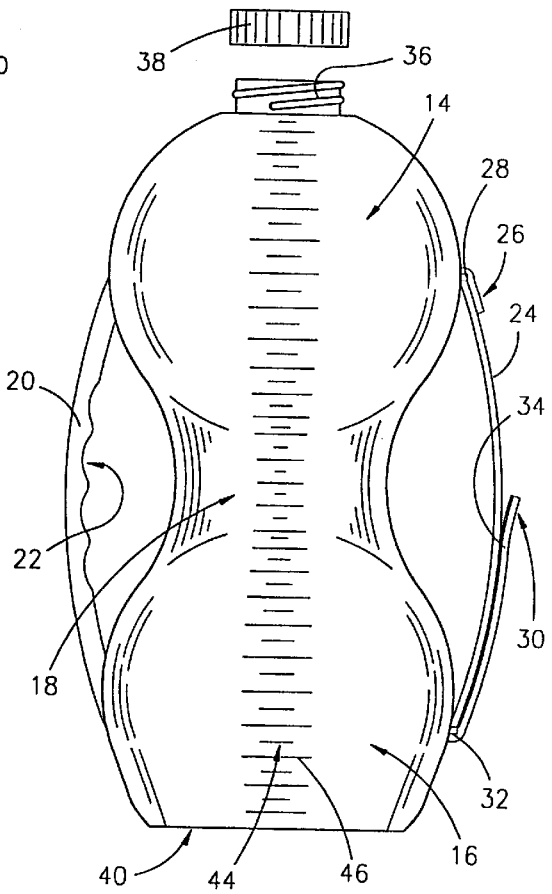
FIG. 2 is a side elevational view of the generally hollow container of the present invention showing the cap on the container fill opening removed.

Extending between top and bottom bulbous sections 14 and 16 is a generally permanent handle 20 which, in the preferred embodiment would have a generally rounded triangular cross-sectional shape. It is also preferred that the interior of handle 20 be hollow and be in fluid connection with the interior volume of container 12, thus allowing fluids and/or solids to pass through handle 20. The handle 20 has an outer surface 21 arranged generally tangential to the top and bottom bulbous sections 14 and 16 as shown in FIG. 2, for minimum outward extension of said handle from said bulbous end sections. It is also seen in FIG. 2 that the maximum outward extension of the handle from the outermost edges of the top and bottom bulbous end sections is generally less than one tenth the longitudinal distance between the ends of the handle. In other words, the maximum distance of the outer edge of the handle from a plane drawn across the outmost edges of the bulbous end sections would preferably not exceed one tenth of the vertical extent of the handle in the position of FIG. 2. Handle 20 would preferably include finger grips 22 which in the preferred embodiment are a plurality of finger-shaped depressions formed in handle 20 on the side adjacent waist section 18. Of course, numerous different types of handles and handle grips may be employed with the present invention so long as the type of handle used is easily grippable by persons of varying hand sizes and strengths who wish to use the exercise apparatus 10 of the present invention.

Detachably mounted on container 12 opposite handle 20 is an adjustable strap 24 which is preferably a strip of fabric extending between top and bottom bulbous sections 14 and 16. One end 26 of adjustable strap 24 is preferably attached to top bulbous section 14 by any suitable means, such as a rivet or staple, but in the preferred embodiment strap end 26 extends through top stirrup 28 and is attached by hook and loop fasteners or the like to the remainder of strap 24 as shown in FIG. 2. The opposite end 30 of adjustable strap 24 then is extended through bottom stirrup 32 on bottom bulbous section 16 and looped over the remainder of the strap 24 and connected thereto by a hook and loop fastener 34 or the like. The length of adjustable strap 24 between stirrups 28 and 32 may thus be adjusted by disengaging hook and loop fastener 34 on strap end 30 and moving strap end 30 towards stirrup 32. Hook and loop fastener 34 is then reattached to strap 24 thus securing strap 24 at a new length. Of course, various types of straps may be used with the present invention, as well as various means for connecting the strap to the container 12.

Figure 3:
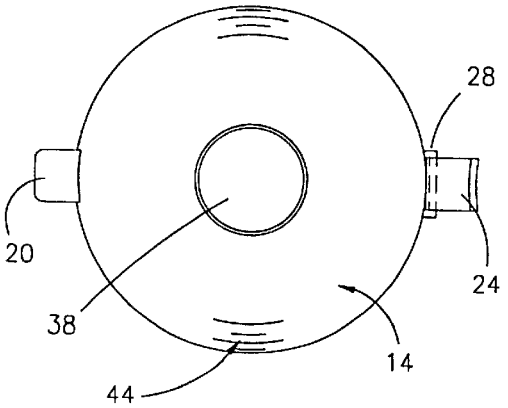
FIG. 3 is a top plan view of the exercise apparatus.

It is preferred that top bulbous section 14 further include a container fill opening 36 and cap 38 for closing the opening 36. Container fill opening 36 allows for the insertion of various liquids and solids into the interior of the container 12 to provide for varying levels of resistance to a person lifting the exercise apparatus 10. Of course, container fill opening 36 may be formed anywhere on container 12, however, it is preferred that container fill opening 36 be formed atop top bulbous section 14 as shown in FIGS. 1–3.

Figure 4:
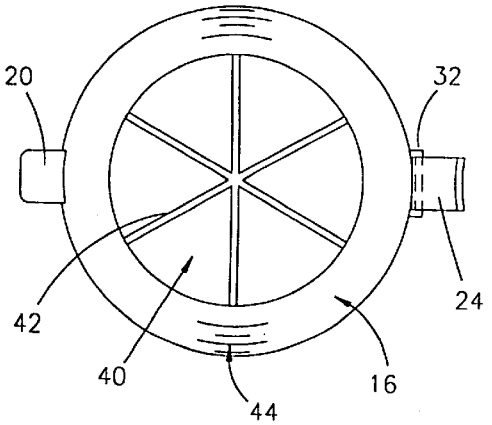
FIG. 4 is a bottom plan view of the exercise apparatus exhibiting the radial ribs on the base.

It is further preferred that bottom bulbous section 16 further include a generally flat base wall 40, shown best in FIG. 4, which includes a plurality of radial ribs 42 which are preferably generally upright sections of semi-rigid plastic and which provide structural rigidity to base wall 40 thus enabling base wall 40 to remain substantially flat. Base wall 40 is included primarily to allow container 12 to stand upright for filling purposes, as container fill opening 36 is then situated at the topmost point of container 12. Of course, inclusion of base wall 40 is not necessary to the present invention, and bottom bulbous section 16 may be constructed to resemble top bulbous section 14 if so desired.

Figure 1:
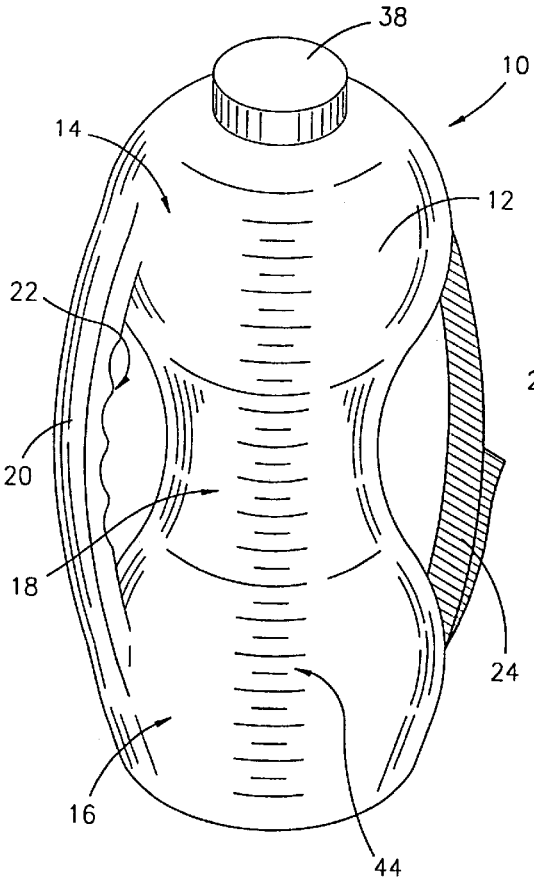
FIG. 1 is a perspective view of the variable resistance refillable exercise apparatus of the present invention.

One important feature of the present invention is the weight scale 44 printed on the side of container 12, as shown in FIGS. 1–4. Weight scale 44 preferably includes a plurality of alternating short and long lines 46 extending generally parallel with base wall 40 and generally perpendicular to the center longitudinal axis of container 12. Weight scale 44 may be read in pounds, kilograms, ounces or any other suitable weight measurement and would preferably include a plurality of numerals 47 printed adjacent the lines 46 to exhibit which line corresponds to what weight measurement. Weight scale 44 is designed such that when container 12 is placed upright resting on base wall 40, as shown in FIGS. 1 and 2, container 12 may be filled with a flowable weight material such as fluids and/or solids to a particular line 46 on weight scale 44, the user of the exercise apparatus 10 will have a generally precise estimate of the amount of weight which he or she is lifting during each repetition. Of course, use of different solids and/or liquids to fill the container 12 will result in various weights due to the varying densities of the substances. Therefore, it is preferred that weight scale 44 have two scales, one for water-filled only and one for sand-filled only, thus covering the two substances most likely to be placed within container 12. In any event, however, weight scale 44 enables a user of the exercise apparatus 10 to obtain a generally precise estimate of how much container 12 will weigh when filled to a certain extent with a particular material.

Figure 5:
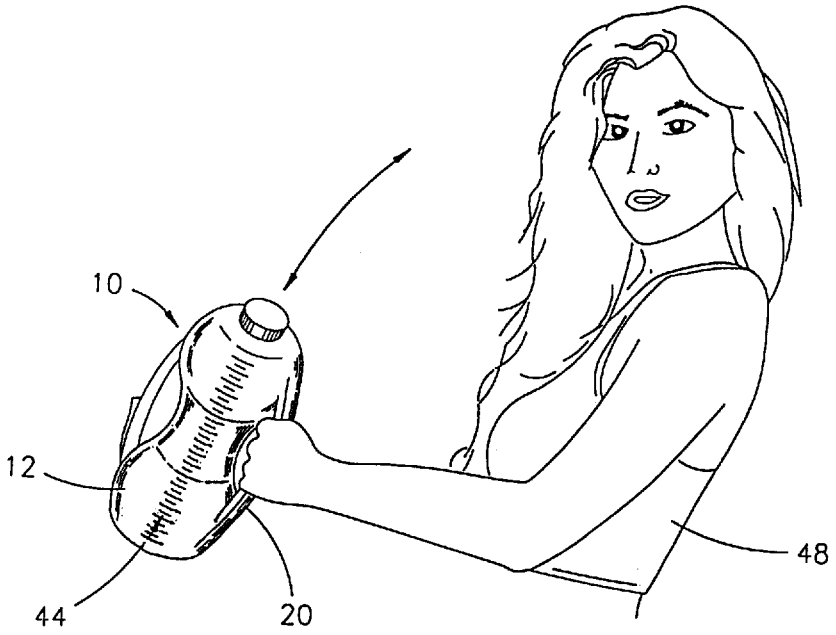
FIG. 5 is a perspective view of a person's arm using the present invention as an exercise apparatus.
Figure 6:
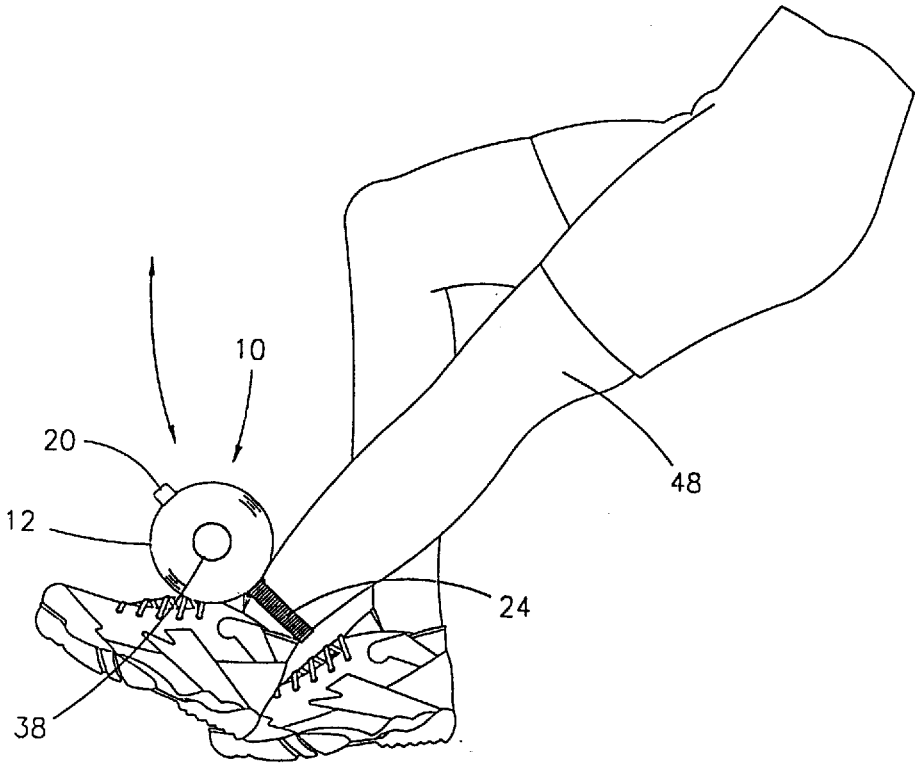
FIG. 6 is a perspective view of a person's leg using the exercise apparatus of the present invention.

FIGS. 5 and 6 illustrate a person 48 using the variable resistance refillable exercise apparatus 10 of the present invention. FIG. 5 exhibits the exercise apparatus 10 filled partially with a fluid or solid such that a predetermined resistance level is set. Of course, the container 12 would be filled through the container fill opening 36 with water or sand or the like. The exercise apparatus 10 would then be used for "curling" exercises which consist of holding the exercise apparatus 10 in one hand and pivoting the exercise apparatus 10 about the elbow of that arm, thereby exercising the bicep muscle.

FIG. 6 exhibits the exercise apparatus 10 being used for exercising of the legs of a user. The container 12 is secured to the ankle of the person by adjustable strap 24 by extending end 30 of strap 24 around the back of the ankle, through bottom stirrup 32 and reattaching end 30 to strap 24 by hook and loop fastener 34. The exercise shown in FIG. 6 concentrates on the quadricep muscle and hip flexors.

Figure 7:
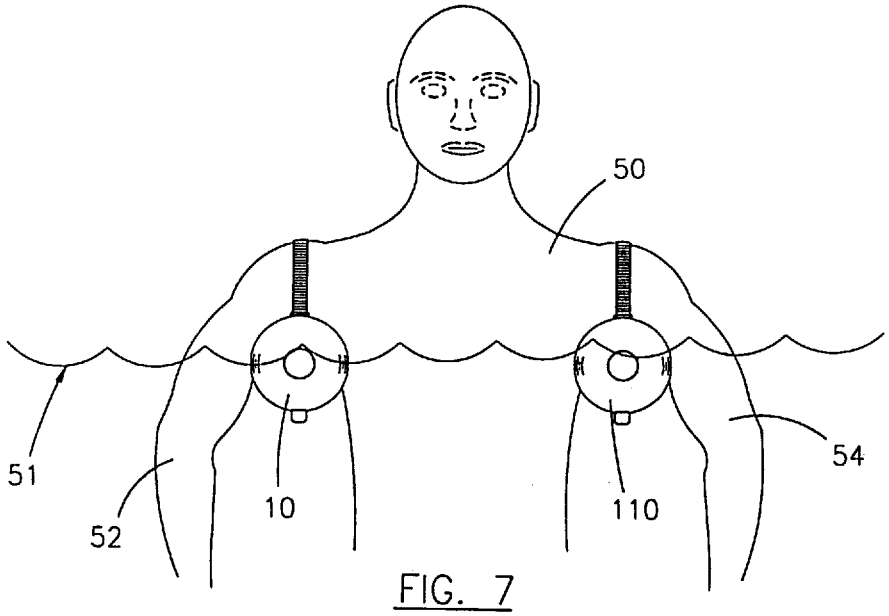
FIG. 7 is a front elevational view of a person in water with two exercise apparati of the present invention attached thereto, one under each arm, thus providing flotation in the water environment.

Another use for the present invention is shown in FIG. 7 as a person 50 is supported in water 52 by a pair of exercise apparati 10 and 110 of the present invention, one secured under each arm 52 and 54 of person 50. When being used as shown in FIG. 7, it is preferred that the exercise apparati 10 and 110 be free of contents and sealed to prevent leakage of water 51 inwards into each apparati 10 and 110. The air trapped within each apparati 10 and 110 thus causes the apparati to float and therefore may be used as flotation devices as shown. It is preferred that exercise apparati 10 and 110 be secured to the shoulders of person 50 in much the same way as was described in connection with FIG. 6 (connection of exercise apparatus 10 to a person's ankle). It is important to note that the gently rounded shape of container 12 easily lends itself to fitting underneath a person's arm, as shown in FIG. 7, and likewise may easily be attached to a person's ankle, because of the curve of waist section 18. The present invention may thus be attached to a person at various location on the person's body without causing discomfort. Each of a person's limbs may thus be exercised.

Figure 8:
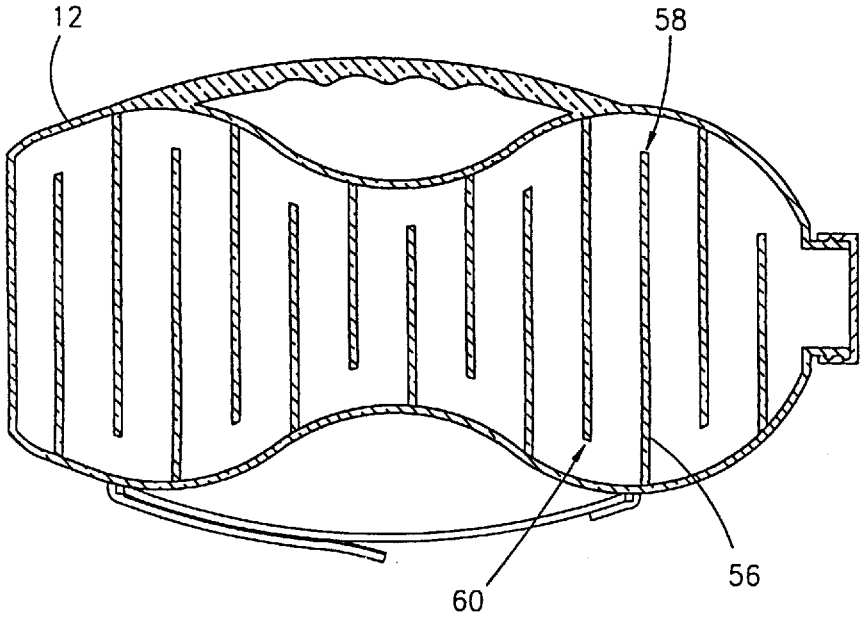
FIG. 8 is a side sectional elevational view of an alternative embodiment of the container further including a plurality of internal baffles for preventing significant movement of fluids and/or solids within the container.

It may be important in some applications of the present invention to prevent significant movement of the contents of the container 12 while exercising motions are being performed. FIG. 8 exhibits one preferred solution to this problem, in which a plurality of baffles 56 are formed within container 12, baffles 56 acting to dampen motion of the contents of the container 12 upon movement of container 12 during exercise. It is preferred that baffles 56 be generally flat partial disks extending across container 12 and connected thereto, yet allowing fluid or particulate solid flow over the top and bottom edges 58 and 60 of the baffles 56, depending upon the orientation of the baffles 56. Substantial motion of the contents of container 12 is thus dampened, thus resulting in smoother motion of container 12 during exercising. Abrupt motion caused by shifting of the contents of container 12 is thus substantially prevented, allowing for use of the exercise apparatus 10 by persons that would be harmed by such abrupt exercise motions.

Figure 9:
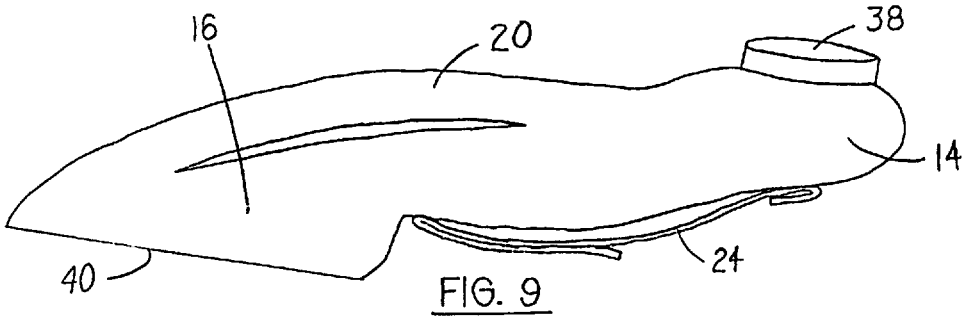

Finally, depending upon the material of which the exercise apparatus 10 of the present invention is constructed, the exercise apparatus 10 may be collapsed as shown if FIG. 9, following removal of the flowable weight material from the container 12, thus allowing for easy transport of the exercise apparatus 10 to a different exercise location. Collapse of container 12 may be done parallel with the center longitudinal axis of the container 12 or generally perpendicular thereto.

It is to be understood that numerous modifications, additions and substitutions may be made to the present invention. For example, the strap may be replaced by another permanent handle to allow for exercises using both arms. Alternatively, a different system of baffles may be included which act to dampen motion of the contents of container 12 in a similarly effective manner as described in connection with baffles 56. Therefore, the scope of the present invention is in no way to be limited by the disclosure of the preferred embodiment above, but rather shall be determined by the scope of the claims set forth below.

There has thus been set forth and described a variable resistance refillable exercise apparatus which accomplishes at least all the stated objectives.

I claim:

1. A variable resistance collapsible exercise apparatus adjustably fillable with a flowable weight material and comprising;

an elongated generally hollow container having an outer surface, an interior volume and a longitudinal central axis, longitudinally spaced apart top and bottom generally bulbous end sections and a reduced circumference waist section between said bulbous end sections such that said container is generally dumbbell-shaped;

said container being made of a semi-flexible plastic material such that said container is collapsible upon removal of weight material therefrom to substantially reduce the size thereof for storage and transport;

said bottom bulbous end section including a generally flat base wall oriented generally perpendicular to said longitudinal central axis whereby said container may stand upright on said flat base wall for filling of said container with flowable weight material;

a container fill opening in said container extending between said outer surface and interior volume for filling said container, said fill opening being positioned on said top bulbous end section opposite said waist section and at the topmost position on said container upon standing of said container on said flat base wall whereby said container may be filled full of flowable weight material through said fill opening;

cap means for removably sealing said container fill opening;

an arcuate handle extending between and connecting said top and bottom generally bulbous end sections, said handle having an outer surface arranged generally tangential to said top and bottom bulbous end sections for minimum outward extension of said handle from said bulbous end sections;

grip means on said handle means for facilitating gripping of said handle means;

a weight scale on said container including a plurality of generally parallel lines arranged generally parallel to said flat base wall and perpendicular to said longitudinal central axis, and at least one weight amount marking adjacent said lines, thereby being operative for measuring flowable weight material input into said container through said fill opening upon positioning of said container on said flat base wall; and a flexible strap extending between and connecting said top and bottom generally bulbous end sections opposite said handle whereby said container may be removably attached to a user of said exercise apparatus.

2. The exercise apparatus of claim 1 wherein the outward extension of said handle beyond the outermost edge of said bulbous end sections is less that one tenth the longitudinal length of said handle.

3. The exercise apparatus of claim 1 wherein said flat base wall includes a plurality of radial ribs comprising upright radial wall sections upon placement of said container on said flat base wall.

4. The exercise apparatus of claim 1 wherein said handle comprises a generally hollow tubular handle extending between and connecting said top and bottom generally bulbous end sections, said handle having a generally rounded triangular cross-sectional shape.

5. The exercise apparatus of claim 4 wherein said grip means comprises a plurality of finger-shaped depressions formed in said handle means whereby gripping of said handle means is facilitated.

6. The exercise apparatus of claim 1 wherein said weight scale further comprises a plurality of alternating short and long generally parallel lines and said weight amount markings comprising a plurality of numerals printed adjacent said generally parallel lines to exhibit which line corresponds to a particular weight measurement.

7. The exercise apparatus of claim 1 wherein said strap comprises a strip of fabric having one strap end extending through a stirrup mounted on said top bulbous section, said one strap end being reattached to said strap, and an opposite strap end extending through a bottom stirrup mounted on said bottom bulbous section, said opposite strap end being connected to said strap by a hook and loop fastener.

* * * * *